US007176780B2

(12) United States Patent
Iwata

(10) Patent No.: US 7,176,780 B2
(45) Date of Patent: Feb. 13, 2007

(54) FUSE UNIT

(75) Inventor: Masashi Iwata, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 187 days.

(21) Appl. No.: 10/977,471

(22) Filed: Nov. 1, 2004

(65) Prior Publication Data

US 2005/0116806 A1 Jun. 2, 2005

(30) Foreign Application Priority Data

Oct. 31, 2003 (JP) ..... P2003-371669
Oct. 31, 2003 (JP) ..... P2003-371670

(51) Int. Cl.
*H01H 85/08* (2006.01)
*H01H 69/02* (2006.01)
*H01H 85/044* (2006.01)
*H01R 4/28* (2006.01)

(52) U.S. Cl. ..... 337/188; 337/161; 337/227; 361/626; 361/833; 439/620.27

(58) Field of Classification Search ..... 337/159, 337/161, 186–188, 227, 283; 439/754, 761, 439/762, 893, 620.26, 620.27; 361/626, 361/833; 320/154
See application file for complete search history.

(56) References Cited

U.S. PATENT DOCUMENTS 4,782,240 A * 11/1988 Davidson ..... 307/10.7
5,643,693 A * 7/1997 Hill et al. ..... 429/121
5,645,448 A * 7/1997 Hill ..... 439/522
5,805,047 A * 9/1998 De Villeroche et al. .... 337/290
5,882,213 A * 3/1999 Witek et al. ..... 439/76.2
5,886,611 A * 3/1999 Schaller et al. ..... 337/189
6,162,098 A * 12/2000 Cheng et al. ..... 439/620.29
6,222,439 B1 * 4/2001 Tanigawa et al. ..... 337/401
6,294,978 B1 * 9/2001 Endo et al. ..... 337/166
6,398,595 B2 * 6/2002 Wakata et al. ..... 439/755
6,509,824 B2 * 1/2003 Inaba et al. ..... 337/295
6,512,443 B1 * 1/2003 Matsumura et al. ..... 337/189
6,576,838 B2 * 6/2003 Matsumura ..... 174/66
6,723,920 B2 * 4/2004 Higuchi et al. ..... 174/50
6,737,578 B2 * 5/2004 Higuchi ..... 174/50
6,793,534 B2 * 9/2004 Cheng et al. ..... 439/620.04
6,806,421 B2 * 10/2004 Matsumura ..... 174/50

(Continued)

FOREIGN PATENT DOCUMENTS

EP 0 884 750 A2 12/1998

(Continued)

*Primary Examiner*—Anatoly Vortman
(74) *Attorney, Agent, or Firm*—Sughrue Mion, PLLC

(57) ABSTRACT

A fuse unit includes first and second fuse devices. Each of the fuse devices includes a attaching portion to be attached to a battery terminal of a battery, a housing provided on the attaching portion and having a cavity which is opened forward and backward of the housing, and a fuse body having a first end which is electrically connected to the battery terminal and a second end which is covered with the housing to form a wire connection part, the fuse body having a fusible portion which is disposed in the cavity. When the housings are superposed in a direction away from the battery, at least one of the housings and the fuse bodies are constructed so that the fusible portions are checked as viewed in a forward direction of the housings.

10 Claims, 13 Drawing Sheets

U.S. PATENT DOCUMENTS

| | | | | |
|---|---|---|---|---|
| 6,817,907 | B2 * | 11/2004 | Cheng et al. | 439/754 |
| 6,828,058 | B2 * | 12/2004 | Ohtsuka et al. | 429/65 |
| 6,902,434 | B2 * | 6/2005 | Stack | 439/620.28 |
| 6,948,982 | B2 * | 9/2005 | Higuchi et al. | 439/620.26 |
| 2001/0011939 | A1 * | 8/2001 | Inaba et al. | 337/265 |

FOREIGN PATENT DOCUMENTS

| | | | | |
|---|---|---|---|---|
| EP | 1 075 012 | A2 | | 2/2001 |
| EP | 1 107 275 | A2 | | 6/2001 |
| EP | 1 107 276 | A2 | | 6/2001 |
| EP | 1 124 246 | A2 | | 8/2001 |
| JP | 8-77913 | A | | 3/1996 |
| JP | 2000-182506 | A | | 6/2000 |
| JP | 2002-329457 | A | | 11/2002 |
| JP | 2004185965 | A | * | 7/2004 |

* cited by examiner

FUSE UNIT

BACKGROUND OF THE INVENTION

The present invention relates to a fuse unit, for example, a fuse unit connected to a battery of a vehicle.

Recently, such a fuse unit as shown in FIG. 14 has been disclosed (For example, refer to JP-A-2002-329457 (FIG. 9)).

As shown in FIG. 14, the fuse unit 100 connects a battery 101 and an electric wire 111 for supplying power to each other, and includes a conductive metal plate fuse element 118 having fuses 114 and 116, and an insulative resin body 117 in which the fuse element 118 is inserted and molded. The resin body 117 has a front side divided body 113 and a rear side divided body 115. Both the divided bodies 113 and 115 are folded at a right angle. A fuse 114 for connecting a connection portion 104 of a battery terminal 102 and an alternator terminal 106 is disposed on the front side divided body 113. Four fuses 116 are disposed in parallel to each other on the rear side divided body 115, and four tab terminals 120 are formed at the tip ends of the fuses 116 (that is, at the downward tip ends in FIG. 14).

A battery terminal 102 is attached to a battery post 119 which is an electrode of the battery 101, and the fuse unit 100 is connected by engaging a stud bolt 103 of the battery terminal 102 in a bolt insertion hole 104*a* of the terminal connection portion 104 and tightening it with a nut 105. Further, the alternator terminal 106 and starter motor terminal 107 are connected by engaging the insertion holes thereof with stud bolts 110 protruding from terminal connection portions 108 and 109 and tightening the same with nuts. The alternator terminal 106 and starter motor terminal 107 are a so-called terminal with electric wires. The electric wires 111 are crimped by a pair of pressure-fit pieces 12 to connect the electric wires 111 to the battery post 119. In addition, the fuse unit 100 and battery terminal 102 are covered with a cover 121 from upward to protect from of dust and humidity.

Therefore, in a state where the fuse unit 100 is attached to the battery 101, the front side divided body 113 is positioned horizontally on the upper surface of the battery 101, and the rear side divided body 115 is positioned at a state where it suspends vertically along the front side 101*a* of the battery 101.

There is a case where two or more fuse units 100 are desired to be provided since the number of tab terminals 120 is short In such a case, it is considered that fuse units 100 are arranged side by side along the side of the battery 101. In this case, there are cases where the distance from the battery post 119 becomes excessively long or it is difficult to laterally dispose the fuse units 100 in view of space.

Therefore, it is considered that the fuse units 100 are superposed and attached in a direction away from the battery 101.

SUMMARY OF THE INVENTION

However, if the fuse units 100 are superposed in a direction away from the battery 101, although it is possible to visually check the state of the fuse 116 of the fuse unit 100 which is positioned externally at the forward (upper side) side, the fuse 116 of the fuse unit 100 attached to the battery 101 side (lower side) cannot be visually checked since the fuse 116 of the fuse unit 100 of the battery side is hidden by the second fuse unit 100. For this reason, in order to visually check the fuses 116, the fuse unit 110 attached at the front is removed or loosened to be moved for visual checking. That is, such a problem arises, by which it is very cumbersome to remove or loosen the same.

The present invention is developed in view of the above-described problem, and it is therefore an object of the invention to provide a fuse unit in which the states of fusible portions of the fuse unit attached to the battery side can be easily checked when the fuse units are superposed in a direction away from a battery.

In order to solve the above-described object, the present invention provides a fuse unit, comprising:

a first fuse device, including:

a first attaching portion to be attached to a battery terminal of a battery;

a first housing provided on the first attaching portion and having a first cavity which is opened forward and backward of the first housing; and a first fuse body having a first end which is electrically connected to the battery terminal and a second end which is covered with the housing to form a wire connection part, the first fuse body having a first fusible portion which is disposed in the first cavity; and a second fuse device, including:

a second attaching portion to be attached to the battery terminal of the battery;

a second housing provided on the second attaching portion and having a second cavity which is opened forward and backward of the second housing; and a second fuse body having a first end which is electrically connected to the battery terminal and a second end which is covered with the housing to form a wire connection part, the second fuse body having a second fusible portion which is disposed in the second cavity, wherein when the first housing and the second housing are superposed in a direction away from the battery, at least one of the first and second housings and the first and second fuse bodies are constructed so that the first and second fusible portions are checked as viewed in a forward direction of the first and second housings.

Preferably, the first fusible portion is deviated from the second fusible portion as viewed in the forward direction of the first and second housings.

In the fuse unit thus constructed, if the attaching portion is attached to the battery terminal, the first and second housings face the battery side. At the same time, if the attaching portions and the fuse bodies included in the housings respectively are electrically connected to the battery, similarly, an electric wire connection parts are formed at the housings via fusible portions. Such fuse devices can be superposed in the direction away from the battery. Where an excessive current flows, the fusible portion is melted to interrupt the current, thereby protecting an electric apparatus. At this time, since the fusible portions shift battery by battery, the first fusible portion does not overlap the second fusible portion. Accordingly, the first fusible portion can be visually checked easily from the front.

Also, a difference between the positions of the fusible portions includes not only a case where the positions of the fusible portions are changed even if the shapes of fuses having a fusible portion are the same but also a case where the positions of the fusible portions are changed by changing the shapes themselves of the fuses and a case where the positions of the fuses are changed.

Preferably, the first fuse body include a first fuse having the first fusible portion, the first fuse being disposed in the first cavity. The second fuse body include a second fuse having the second fusible portion, the second fuse being disposed in the second cavity. A position of the first fusible portion with respect to the fist fuse is different from a position of the second fusible portion with respect to the second fuse.

In the fuse unit thus constructed, since the positions of the fusible portions of fuses are shifted, the fusible portion of the battery side fuse unit does not overlap the fusible portion of the forward fuse units. Therefore, it is possible to visually check the battery side fuse unit easily from the front.

Preferably, the first fuse body include a first fuse having the first fusible portion, the first fuse being disposed in the first cavity. The second fuse body include a second fuse having the second fusible portion, the second fuse being disposed in the second cavity. A position of the fist fuse with respect to the first cavity is different from a position of the second fuse with respect to the second cavity.

In such a fuse unit thus constructed, since the positions of the fusible portions shift by shifting the positions of the fuses in the cavities, the fusible portion of the battery side fuse unit does not overlap the fusible portion of the forward fuse units. Therefore, it becomes possible to visually check the fusible portions of the battery side fuse unit easily from the front.

Preferably, a position of the fist cavity with respect to the first housing is different from a position of the second cavity with respect to the second housing.

In such a fuse unit thus constructed, since the cavities are shifted housing by housing, the positions of the fusible portions accommodated in the cavities are shifted housing by housing. Therefore, the fusible portion of the battery side fuse unit does not overlap the fusible portion of the forward fuse units, and it becomes possible to visually check the fusible portions of the battery side fuse unit easily from the front.

Preferably, when the first fuse device and the second fuse device are attached to the battery terminal of the battery, the first housing is superposed to the second housing with an offset.

In such a fuse unit thus constructed, since the attaching positions of housings are shifted, the positions of the cavities are shifted housing by housing, and the positions of the fusible portions accommodated in the cavities are also shifted housing by housing. Therefore, the fusible portion of the battery side fuse unit does not overlap the forward fuse unit, wherein it becomes possible to visually check the fusible portions of the battery side fuse unit easily from the front.

Preferably, a shape of the first cavity is different from that of the second cavity.

Preferably, the second housing is further away from the battery than the first housing. A width of an inner face of the second housing defining the second cavity is greater than that of an inner face of the first housing defining the first cavity.

Preferably, the inner face of the second housing is widened toward a direction toward the second housing from the first housing.

when the first housing and the second housing are superposed in the direction away from the battery in a state that the second housing is further away from the battery than the first housing, a gap is exist between the first housing and the second housing so as to expose the second fusible portion to outside.

In the fuse unit thus constructed, when the attaching portion is attached to the battery terminal, the housing faces the side of the battery. At the same time, the fuse body included in the attaching portion and housing is electrically connected to the battery, simultaneously, an electric wire connection portion is formed in the housing via a fusible portion. Such a fuse unit can be superposed in the direction away from the battery, wherein if an excessive current flows, the fusible portion is melted to interrupt the current, thereby protecting an electrical apparatus. At this time, since the shapes of the cavities in which the fusible portion is accommodated are changed housing by housing, it is possible to easily and visually check fusible portions of both fuse units even in a case where the fusible portion of the battery side fuse unit and the forward fusible portion overlap each other.

According to the invention, since the positions of the fusible portions differ housing by housing, the fusible portion of the battery side fuse unit does not overlap the fusible portion of the forward fuse unit, wherein it becomes possible to visually check the fusible portions of the battery side fuse unit easily from the front.

According to the invention, since the shapes of cavities differ from each other in respective housings, it becomes possible to easily and visually check both fusible portions even in a case where the fusible portion of the battery side fuse unit and the fusible portion of the forward fuse unit overlap each other.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
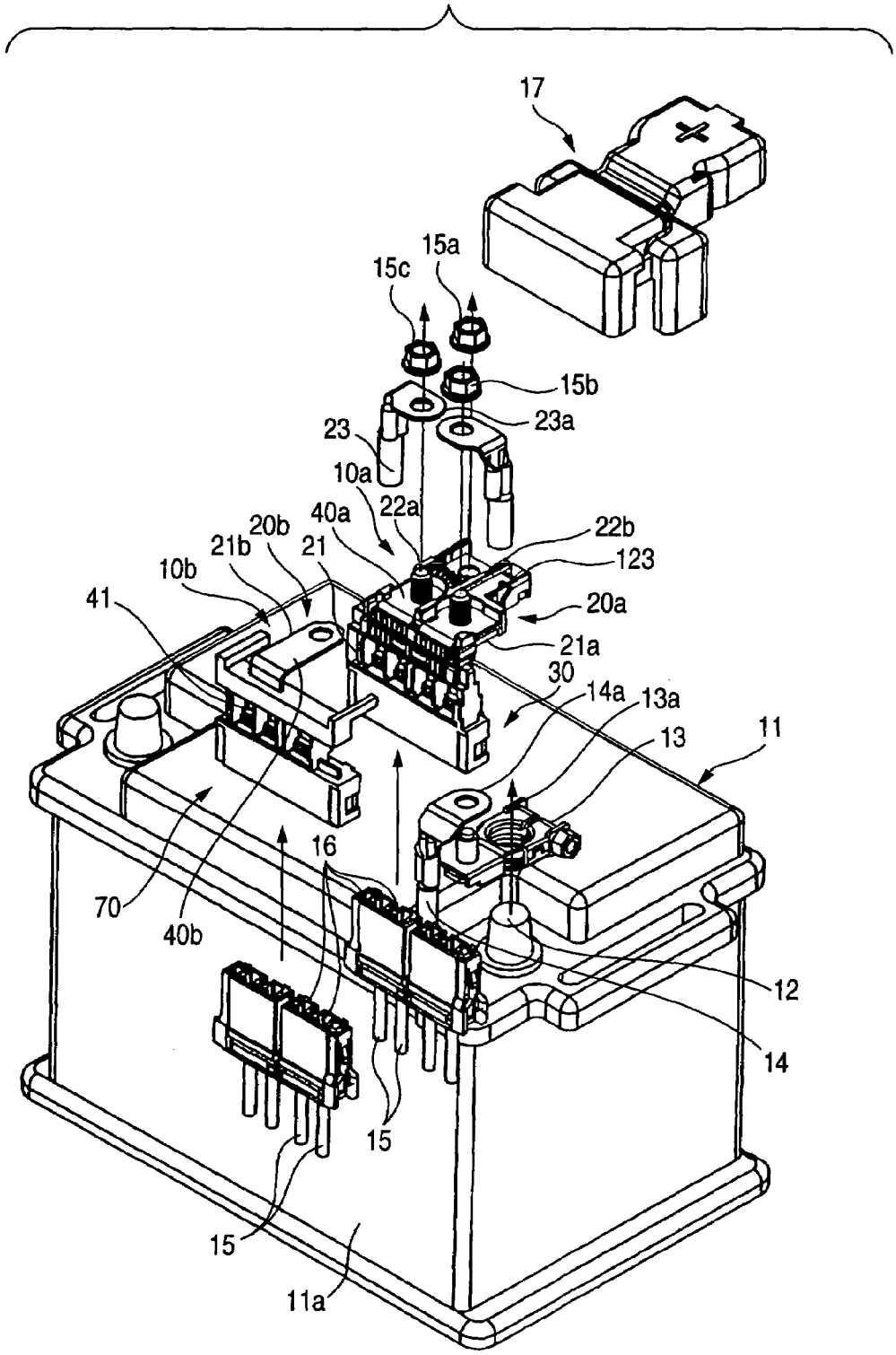
FIG. 1 is a disassembled perspective drawing showing a state of attaching a fuse unit according to the invention to a battery.
Figure 3:
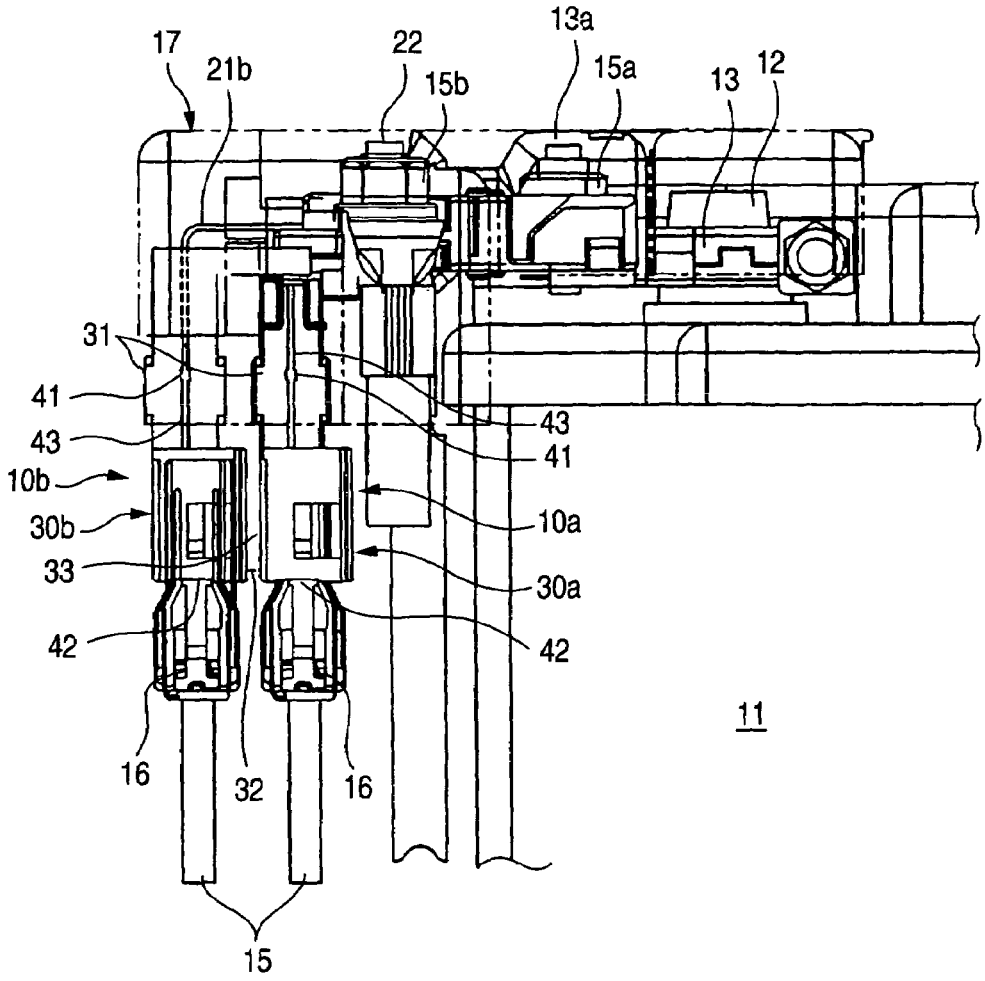
FIG. 3 is a side view of the fuse unit.
Figure 4:
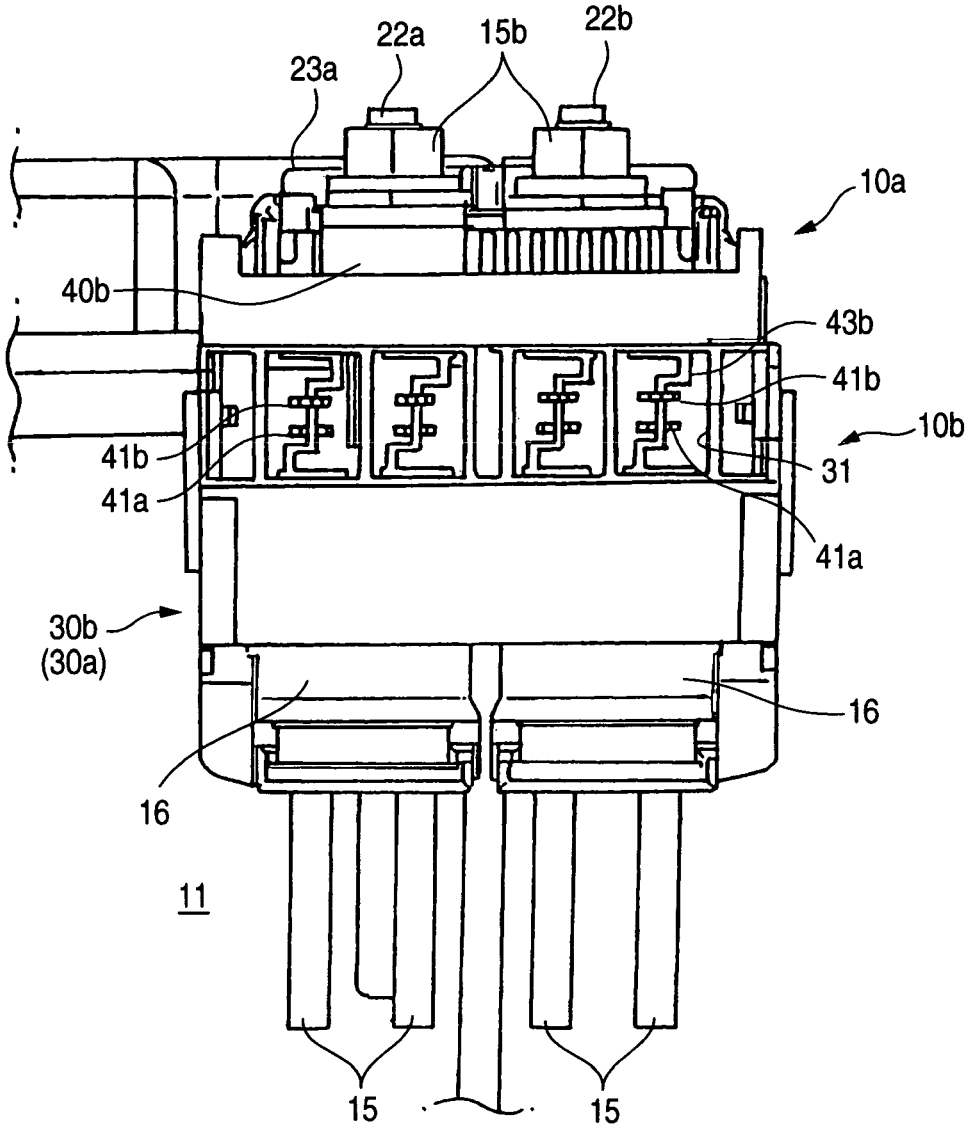
FIG. 4 is a front view of the fuse unit.
Figure 5A:
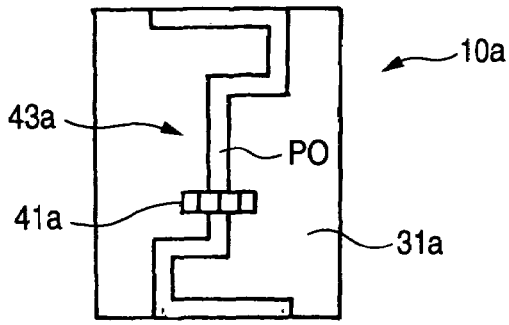
FIG. 5A is a front view showing the battery side fuse unit.
Figure 5B:
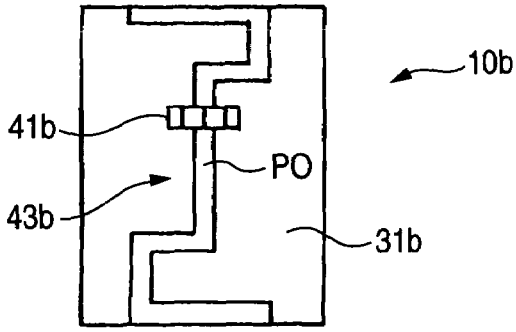
FIG. 5B is a front view showing the forward fuse unit.
Figure 5C:
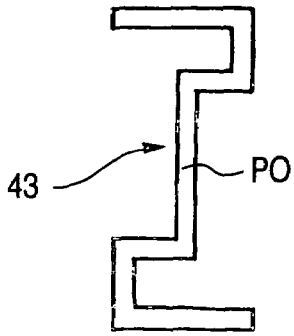
FIG. 5C is a front view showing the shape of the fuse.

Hereinafter, a description is given of embodiments according to the invention with reference to the accompanying drawings. FIG. 1 is a disassembled perspective view showing a state of attaching a fuse unit according to the invention in a battery, FIG. 2 is a plan view of the fuse unit, FIG. 3 is a side view of the fuse unit, FIG. 4 is a front view of the fuse unit, FIG. 5A is a front view showing the battery side fuse, FIG. 5B is a front view showing the forward fuses, and FIG. 5C is a front view showing the shape of a fuse.

FIG. 1 shows a state where two fuse units 10*a* and 10*b* according to the invention are superposed in the direction away from a battery 11. The respective fuse units 10*a* and 10*b* include attaching portions 20*a* and 20*b* having arms 21*a* and 21*b* of a predetermined length, which are attached to the battery post 12 being an electrode of the battery 11, housings 30*a* and 30*b*, which are formed by being bent at a right angle from the arms 21*a* and 21*b* and the battery side face 11*a*, and fuse bodies 40*a* and 40*b* having one end thereof electrically connected to the battery post 12 and the other end thereof included in the housings 30*a* and 30*b*, which form a connector 42 operating as an electric wire connection portion via a fusible portion 41, respectively.

Figure 2:
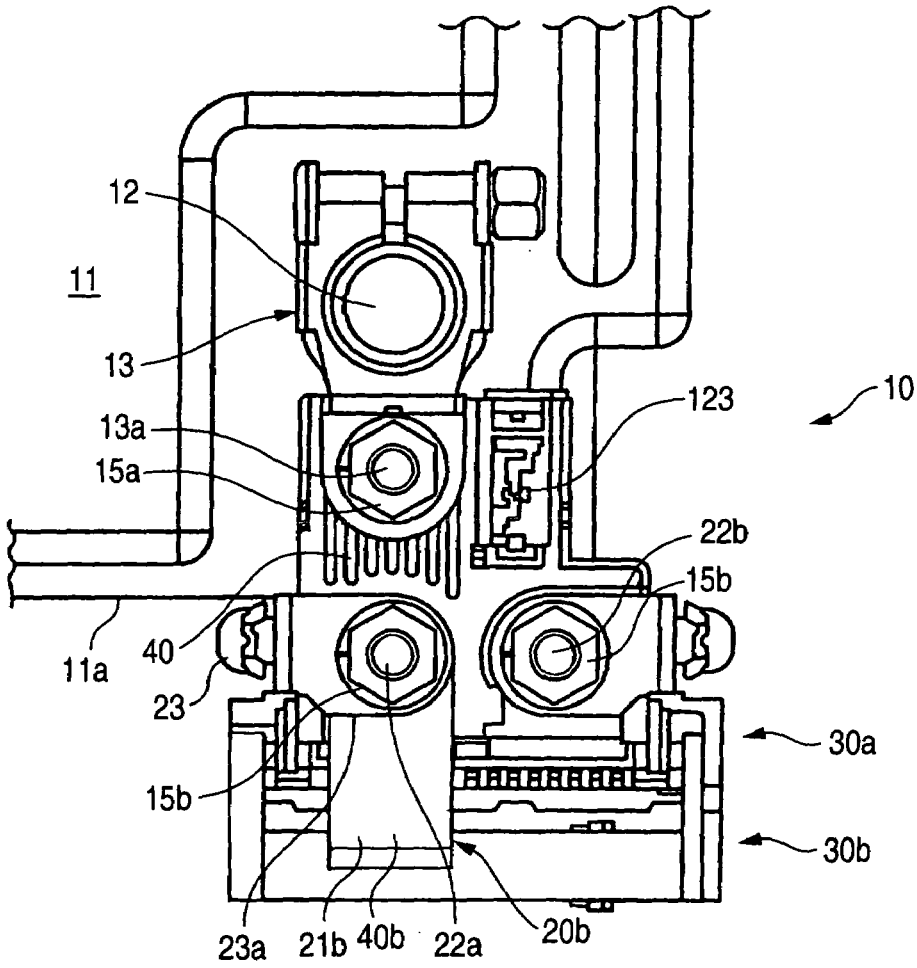
FIG. 2 is a plan view of the fuse unit.

As shown in FIG. 1 and FIG. 2, the battery terminal 13 is attached to the battery post 12. A starter terminal 14*a* attached to the end part of the starter wire 14 and the attaching portion 20*a* of the fuse unit 10*a* attached externally at the battery 11 side (hereinafter called the "first fuse unit 10*a*") are attached to the stud bolt 13*a* of the battery terminal 13. The attaching portion 20*a* is configured so as to expose one end of the fuse body 40*a*, and the fuse body 40 and battery 11 are electrically connected to each other by setting the nut 15*a* on the stud bolt 13*a*.

At the attaching portion 20*a* of the first fuse unit 10*a*, two stud bolts 22*a* and 22*b* are provided on the upper surface of the fuse body 40. An alternator terminal 23*a* attached to the tip end of the alternator wire 23 is electrically connected to the stud bolt 22*a* by being set with the nut 15*b*, and at the same time, the attaching portion 20*b* of the forward fuse unit 10*b* (hereinafter called the "second fuse unit 10*b*") is set thereto with the nut 15*b*. The fuse body 40*b* is exposed at the attaching portion 20*b* of the second fuse unit 10*b* and is electrically connected to the attaching portion 20*a* of the first fuse unit 10*a*. Also, the stud bolt 22*b* is electrically connected to the battery post 12 via the fuse 123, wherein any current over a predetermined level does not flow.

Also, the attaching portion 20*a*, stud bolts 22*a* and 22*b*, etc., are covered with the cover 17 from upward, thereby it is possible to prevent trouble or inconvenience such as defective connection, short-circuiting, etc., due to adhesion of dust and humidity.

As shown in FIG. 1 and FIG. 3, the fuse bodies 40*a* and 40*b* are folded downward at 90 degrees from the tip ends of the arms 21*a* and 21*b* of the attaching portions 20*a* and 20*b*, and housings 30*a* and 30*b* made of insulative resin are integrally molded so as to cover the fuse bodies 40*a* and 40*b*. The lengths of the arms 21*a* and 21*b*, that is, the lengths to the point to which the fuse bodies are caused to extend by folding at 90 degrees from the attaching portion with the battery post 12, are adequately established on the basis of the thickness of the housings 30*a* and 30*b*. The lower ends of the housings 30*a* and 30*b* have openings, and the tip ends of the fuse bodies 40*a* and 40*b* are exposed from the opening, thereby forming a female type connector 42. Therefore, power can be supplied by inserting a male type connector 16 attached to the tip end of the electric wire 15 into the connector 42. The electric wire 15 is connected to an electric apparatus.

FIG. 4 is a front view of the first housing 30*a* and the second housing 30*b* of a first embodiment of the invention. However, the first housing 30*a* is hidden behind the second housing 30*b*. Cavities 31, which are made open to the front side and are internal spaces, are disposed side by side in the housing 30*b*. A fuse 43 serving as a fusing body having a fusible portion 41 is provided at the position corresponding to the cavity 31 in the fuse body 40*b*, the battery 11 side and the connector 42 side in the fuse body 40 are electrically connected to each other via the fuse 43.

Also, the fuse bodies 40*a* and 40*b* are made integral with each other at the battery post 12 side from the fuse 43, but are electrically separated from each other at the connector 42 side and further extend, thereby individually forming connectors 42 independently.

In addition, when producing the fuse units 10*a* and 10*b*, the fuse bodies 40*a* and 40*b* each including a fuse 43 having a fusible portion 41 at a predetermined position are made plane-shaped, then housing 30*a* and 30*b* and attaching portions 20*a* and 20*b* are integrally molded on the fuse bodies 40*a* and 40*b* by using resin. After that the fuse bodies 40*a* and 40*b* are folded downward at a right angle.

As shown in FIG. 4, in the case where the shape of the housings 30*a* and 30*b* and shape of the cavities 31*a* and 31*b* in the first fuse unit 10*a* are identical to those in the second fuse unit 10*b*, both the housings 30*a* and 30*b* and cavities 31*a* and 31*b* completely overlap each other. Therefore, the fuse 43*a* positioned in the cavity 31*a* of the housing 30*a* is hidden behind the fuse 43*b* positioned in the cavity 31*b* of the housing 30*b*. In this case, the vertical positions of the fusible portions 41*a* and 41*b* are shifted in the fusible portion 41*a* of the fuse 43*a* and the fusible portion 41*b* of the fuse 43*b*, wherein the fusible portions 41*a* and 41*b* can be distinguished from each other from the view from forward and can be visually checked.

That is, as shown in FIG. 5A, the fusible portion 41*a* of the fuse 43*a* of the first fuse unit 10*a* is disposed at a lower position than the center P0 of the fuse 43*a*. On the other hand, as shown in FIG. 5B, the fusible portion 41*b* of the fuse 43*b* of the second fuse unit 10*b* is disposed at a higher position than the center P0 of the fuse 43*b*. This is because, as shown in FIG. 5C, the shape of the fuse 43 is point-symmetrical with respect to the center P0, and where the fusible portion 41 is provided at a position deviated from the center P0, it is possible to easily shift the heights of the fusible portions 41*a* and 41*b* by reversing the fusible portion by 180 degrees. Therefore, as shown in FIG. 4, when being viewed from the front, it is possible to visually check the states of both the fusible portions 41*a* and 41*b*. In addition, when the fusible portion 41*a* is disposed upward of the center and the fusible portion 41*b* is disposed downward of the center, this is completely the same as the above.

Figure 6:
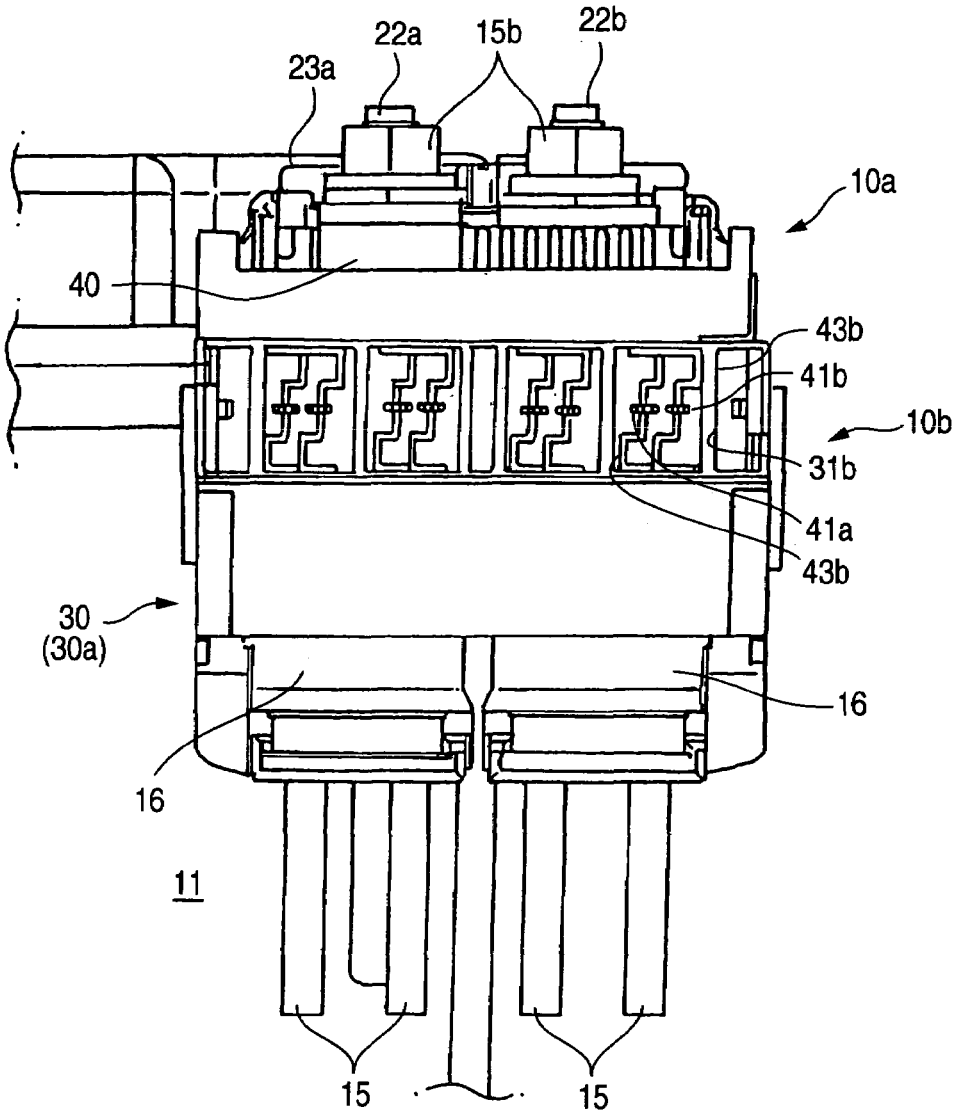
FIG. 6 is a front view showing another embodiment in which the battery side fuse and the forward fuse are shifted.
Figures 7A, 7B:
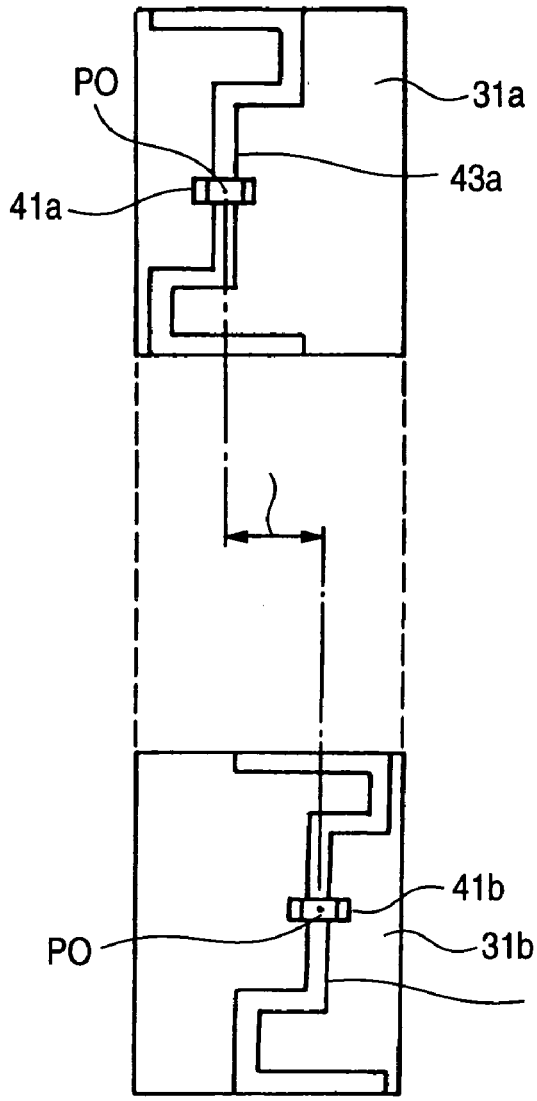
FIG. 7A is a front view showing arrangement of the battery side fuse.
FIG. 7B is a front view showing arrangement of the forward fuse.

FIG. 6 is a front view showing a case where the battery side fuse and the forward fuse are shifted in relation to each other according to a second embodiment of the invention. FIG. 7A is a front view showing arrangement of the battery side fuse, and FIG. 7B is a front view showing arrangement of the forward fuse.

As shown in FIG. 7A and FIG. 7B, by shifting the positions of the fuses 43*a* and 43*b* in the cavities 31*a* and 31*b*, the fusible portion 41*a* of the first fuse unit 10*a* and the fusible portion 41*b* of the second fuse unit 10*b* are disposed so that the fuses 43*a* and 43*b* do not overlap each other. As a result, as shown in FIG. 6, the fuse units 10*a* and 10*b* are observed from the front side, it is possible to visually check the fusible portions 41*a* and 41*b* at the same time through the forward cavity 31*b*.

Also, in this case, the fusible portions 41*a* and 41*b* may be provided at the center position of the fuses 43*a* and 43*b*.

Also, as in the case shown in FIG. 4 and FIG. 5, the fusible portions 41*a* and 41*b* may be disposed so as to be shifted vertically.

Figures 8A, 8B:
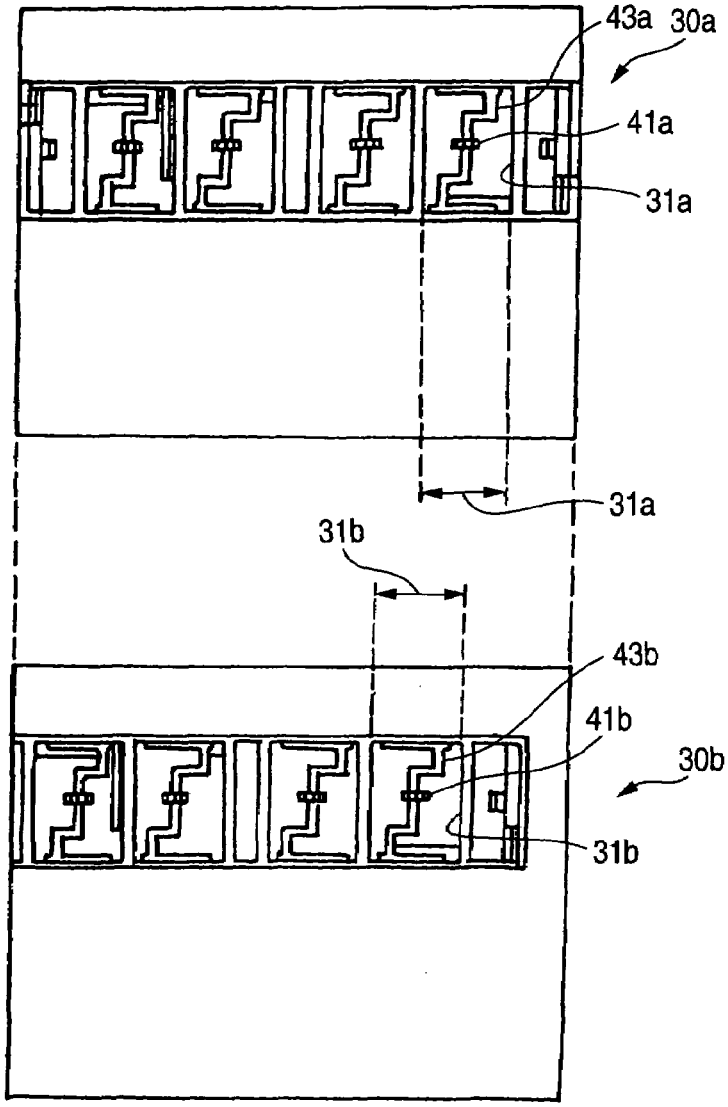
FIG. 8A and FIG. 8B are front views of housings in which cavities are shifted.

FIG. 8A and FIG. 8B show a case where the positions of the cavities 31*a* and 31*b* are shifted with respect to the housings 30*a* and 30*b* according to a third embodiment of the invention.

In this case, the housings 30*a* and 30*b*, in which the sizes of the cavities 31*a* and 31*b*, sizes and shapes of the fuses 43*a* and 43*b*, and arrangement of the cavities 31*a* and 31*b* are identical to each other, are disposed so as to overlap each other. Since the positions of the fuses 43*a* and 43*b* are shifted by shifting the positions of the cavities 31*a* and 31*b* with respect to the housings 30*a* and 30*b* in the horizontal direction although the positions of the housings 30*a* and 30*b* are the same, the fusible portions 41*a* and 41*b* are shifted so as not to overlap each other. Therefore, it is possible to visually check the fusible portion 41*a* of the first fuse unit 10*a* and the fusible portion 41*b* of the second fuse unit 10*b* in view from the front side.

Figures 9A, 9B:
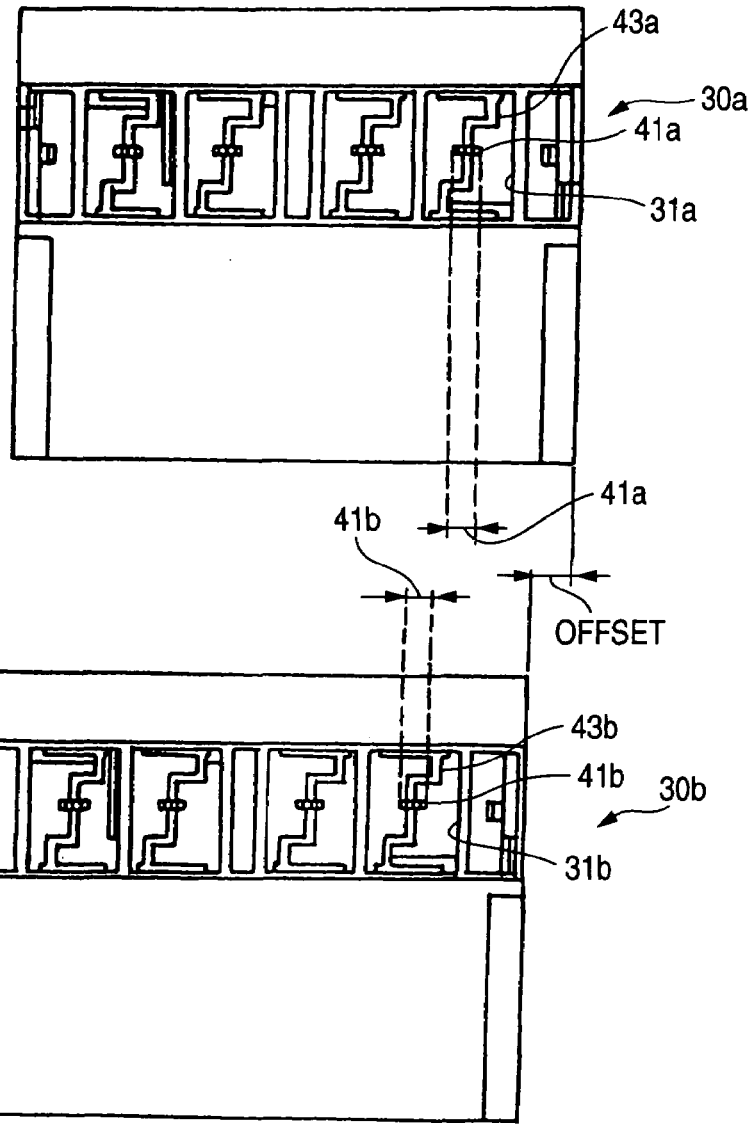
FIG. 9A and FIG. 9B are descriptive views showing a case where the attaching position of the housing is shifted.

FIG. 9A and FIG. 9B show a case where the attaching positions of the housing 30*a* and 30*b* are shifted according to a fourth embodiment of the invention.

In this case, the housings 30*a* and 30*b*, in which the sizes and arrangement of the cavities 31*a* and 31*b*, sizes and shapes of the fuses 43*a* and 43*b* and arrangement thereof in the cavities 31*a* and 31*b* are identical to each other, are attached with their positions in the horizontal direction shifted. Since the positions of the fuses 43*a* and 43*b* are shifted by shifting the entirety of the housings 30*a* and 30*b*, the fusible portions 41*a* and 41*b* are shifted so as not to overlap each other, it is possible to visually check from the front side the fusible portions 41*a* of the first fuse unit 10*a* and the fusible portion 41*b* of the second fuse unit 10*b*.

Figure 11A:
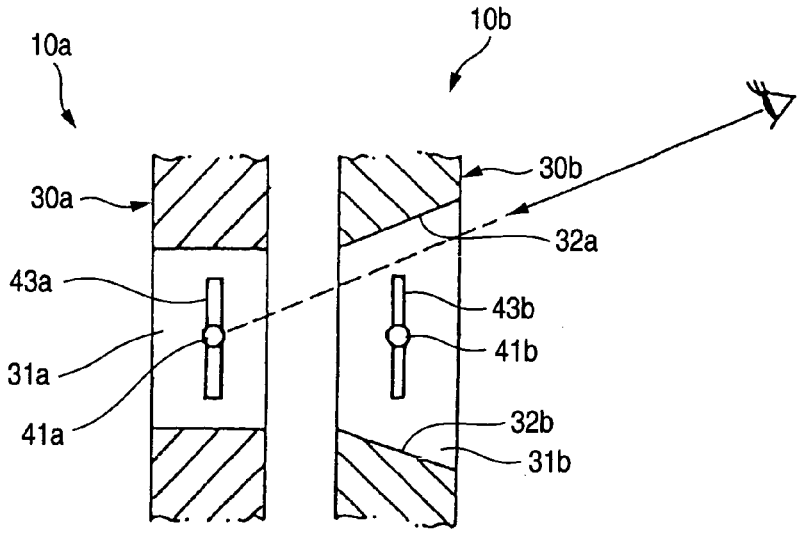
FIG. 11A is a front view showing one example of a change in the shapes of the cavities and a line of sight thereof.
Figure 11B:
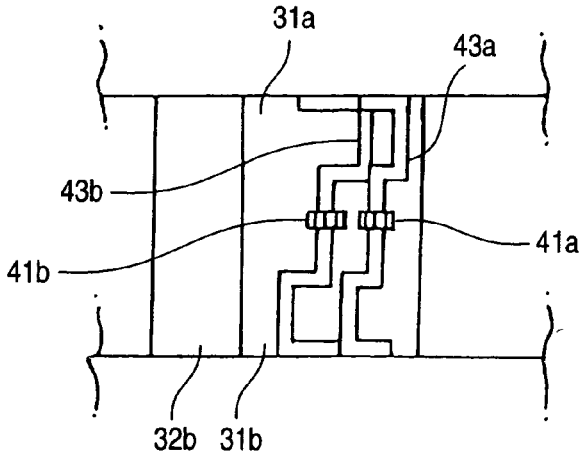
FIG. 11B is a front view showing the fuse in the line of sight in (A)

FIG. 11A is a plan view showing a cavity secured in the housing of the battery side fuse unit and a cavity secured in the housing of the forward fuse unit according to a fifth embodiment of the invention, and FIG. 11B is a front view observed from the direction of the arrow in (A).

The cavities 31*a* and 31*b* having different shapes are provided in the housings 30*a* and 30*b* as shown in FIGS. 11A and 11B.

In FIG. 11A, the cavity 31*a* formed in the housing 30*a* of the first fuse unit 10*a* is normally sized and has a rectangular section. On the other hand, although the cavity 31*b* formed in the housing 30*b* of the second fuse unit 10*b* has almost the same width at its rear side (the left side in FIG. 11A) as that of the cavity 31*a*, the cavity 31*b* has the inclined planes 32*a* and 32*b* widened toward the front side (the right side in FIG. 11A), and its section is made trapezoidal.

As described above, according to the fuse units 10*a* and 10*b* according to the fifth embodiment, since the front side of the second cavity 31*b* is widened as shown in FIG. 11B, the fusible portion 41*a* disposed inside the first cavity 31*a* can be visually checked through the cavity 31*b* at the side of the fusible portion 41*b* disposed in the second cavity 31*b*, whereby it is possible to easily grasp the states of the fuses 43*a* and 43*b*.

Figure 12:
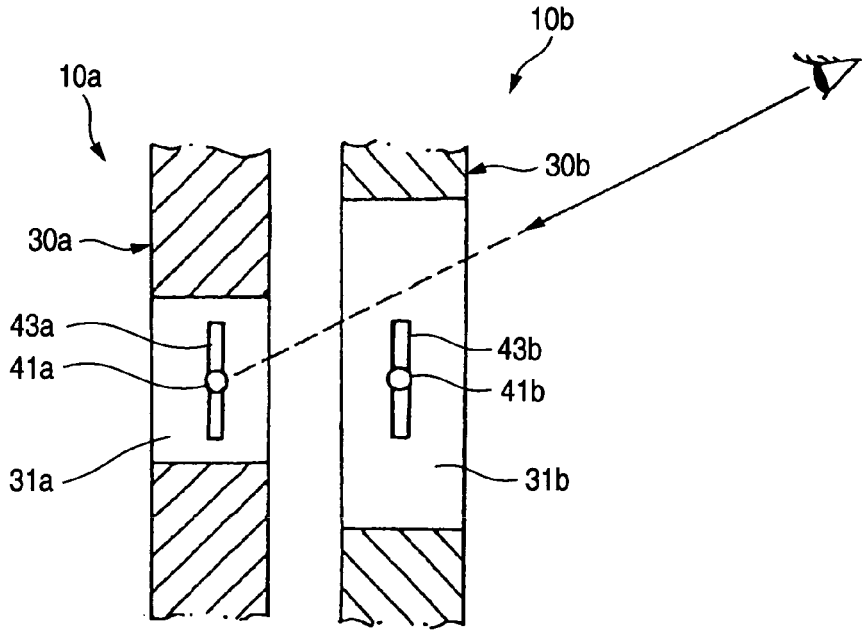
FIG. 12 is a plan view showing another example showing a change in the shapes of cavities.

Also, as shown in FIG. 12, the same effect can be completely brought by enlarging the width of the second cavity 31*b* instead of forming the inclined planes 32*a* and 32*b* in the second cavity 31*b*.

Figure 13:
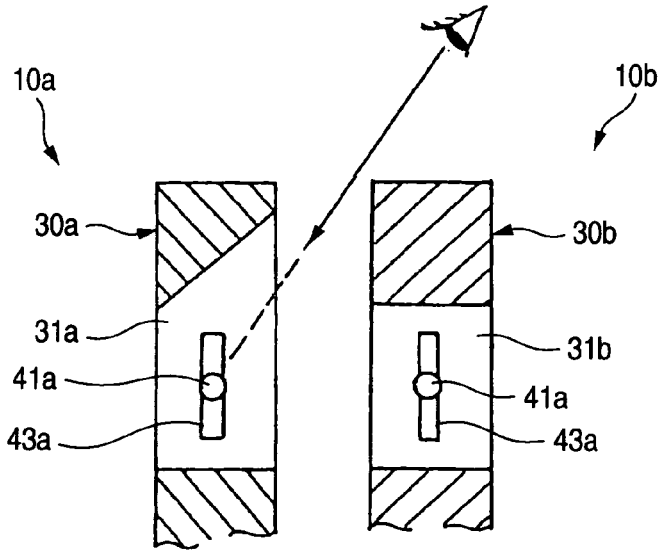
FIG. 13 is a plan view showing still another example showing a change in the shapes of cavities.
Figure 14:
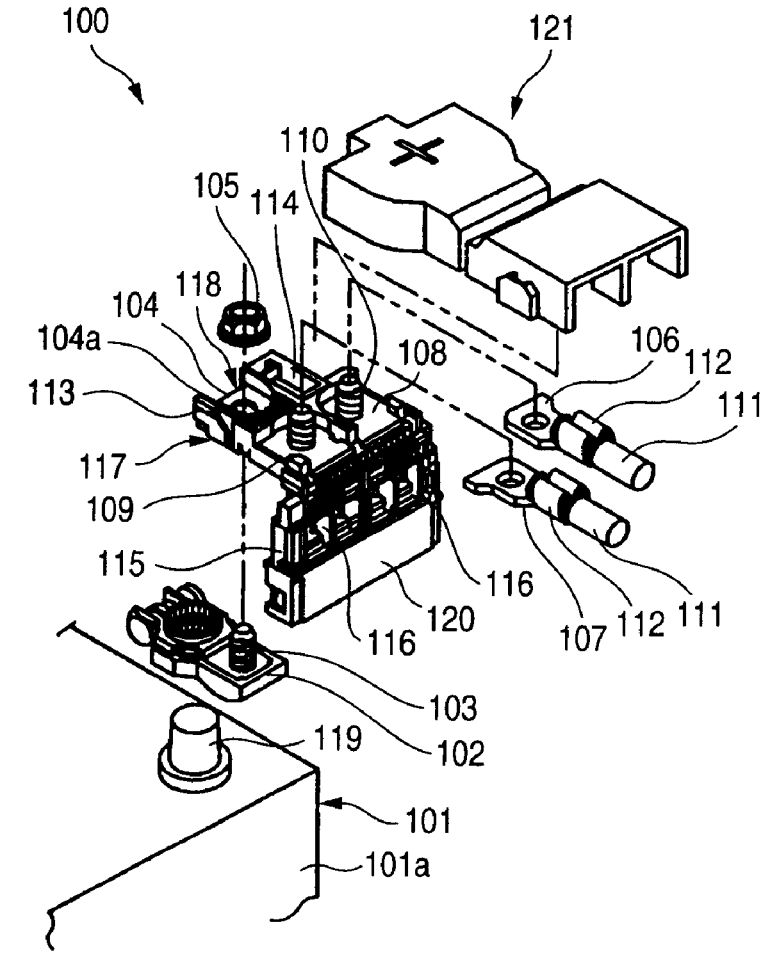
FIG. 14 PRIOR ART
FIG. 14 is a disassembled perspective view showing a prior art fuse unit.

FIG. 13 shows the shapes of the first cavity 31*a* and second cavity 31*b* according to a sixth embodiment of the invention. In the fuse units 10*a* and 10*b* described with reference to FIGS. 11A, 11B and FIG. 12, a description was given of a case where the first fusible portion 41*a* accommodated in the first cavity 31*a* is visually checked through the second cavity 31*b*. However, as shown in FIG. 13, the first fusible portion 41*a* may be devised so as to be visually checked not through the second cavity 31*b*.

That is, where large clearance 33 is interposed between the first housing 30*a* and the second housing 30*b*, or the forward side of the cavity 31 formed at the end part of the housing 30*a* is widened, as shown by the arrow in FIG. 13, the fusible portion 41*a* accommodated in the first cavity 31*a* can be visually checked between the first housing 30*a* and the second housing 30*b*.

As described above, according to the above-described fuse units 10*a* and 10*b*, by widening the front side of the first cavity 31*a*, the fusible portion 41*a* disposed inside the first cavity 31*a* can be visually checked not through the cavity 31*b*, wherein it is possible to easily grasp the states of the fuses 43*a* and 43*b*.

Also, the fuse units 10*a* and 10*b* according to the invention are not limited to the above-described embodiments. The fuse units 10*a* and 10*b* may be subject to various adequate modifications and improvements.

For example, although, in the above-described fuse units 10*a* and 10*b*, a description is given of a case where two housings 30*a* and 30*b* are superposed in the direction away from the battery 11, the embodiment may be applicable to a case where three or more housings 30 are superposed.

Although, in the above-described fuse units 10*a* and 10*b*, the shapes of the cavities 31*a* and 31*b* secured in the housings 30*a* and 30*b* are changed in the left and right directions and the shape of the first cavity 31*a* is made different from that of the second cavity 31*b*, it is possible to change the shapes of the cavities 31*a* and 31*b* in the up and down directions in accordance with the shapes of the housings 30*a* and 30*b*. In this case, it becomes possible to visually check the first fusible portion 41*a* from the forward up and down directions of the second housing 30*b*.

Figure 10:
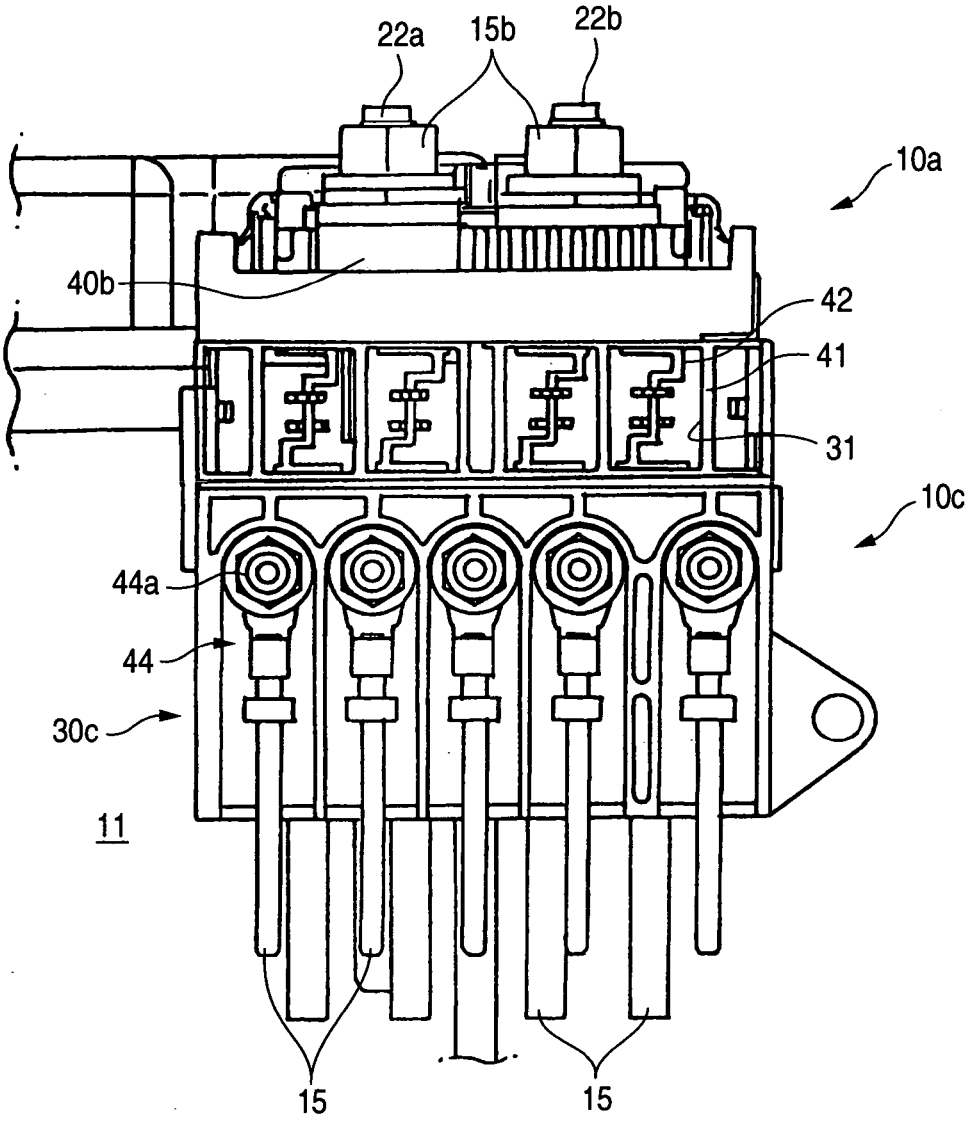
FIG. 10 is a front view showing another example of the housing.

In addition, in the above-described fuse units 10*a* and 10*b*, a description was given of a case where the connector 42 is provided at the tip end (lower end) of the housings 30*a* and 30*b*. However, as in the fuse unit 10*c* shown in FIG. 10, a terminal 44 for connecting the electric wire 15 by a screw 44*a* instead of the connector 42 may be provided in the housing 30*c*. This is limited to the fuse unit 10*c* superposed at the uppermost layer so as to enable an operation from the front side. The other fuse units 10*a* and 10*b* may be a fuse unit of such a type as a connector 16 can be connected from downward.

Also, changes in the shapes of the above-described cavities 31*a* and 31*b* are only for illustration. It is possible that the shapes, arrangement and thickness of the housings 30*a* and 30*b* are variously changed. Also, it is not necessary that the shapes of the cavities 31*a* and 31*b* are the same as each other in the housings 30*a* and 30*b*, and it is possible that the shapes of the cavities 31*a* and 31*b* are made different from each other in the housings 30*a* and 30*b*.

What is claimed is:

1. A fuse unit, comprising:

a first fuse device, including:

a first attaching portion to be attached to a battery terminal of a battery;

a first housing provided on the first attaching portion and having a first cavity which is opened forward and backward of the first housing; and a first fuse body having a first end which is electrically connected to the battery terminal and a second end which is covered with the housing to form a wire connection part, the first fuse body having a first fusible portion which is disposed in the first cavity; and a second fuse device, including:

a second attaching portion to be attached to the battery terminal of the battery;

a second housing provided on the second attaching portion and having a second cavity which is opened forward and backward of the second housing; and a second fuse body having a first end which is electrically connected to the battery terminal and a second end which is covered with the housing to form a wire connection part, the second fuse body having a second fusible portion which is disposed in the second cavity, wherein when the first housing and the second housing are superposed in a direction away from the battery, at least one of the first and second housings and the first and second fuse bodies are constructed so that the first and second fusible portions are checked as viewed in a forward direction of the first and second housings.

2. The fuse unit as set forth in claim 1, wherein the first fusible portion is deviated from the second fusible portion as viewed in the forward direction of the first and second housings.

3. The fuse unit as set forth in claim 1, wherein the first fuse body include a first fuse having the first fusible portion, the first fuse being disposed in the first cavity;

wherein the second fuse body include a second fuse having the second fusible portion, the second fuse being disposed in the second cavity; and wherein a position of the first fusible portion with respect to the fist fuse is different from a position of the second fusible portion with respect to the second fuse.

4. The fuse unit as set forth in claim 1, wherein the first fuse body include a first fuse having the first fusible portion, the first fuse being disposed in the first cavity;

wherein the second fuse body include a second fuse having the second fusible portion, the second fuse being disposed in the second cavity; and wherein a position of the fist fuse with respect to the first cavity is different from a position of the second fuse with respect to the second cavity.

5. The fuse unit as set forth in claim 1, wherein a position of the fist cavity with respect to the first housing is different from a position of the second cavity with respect to the second housing.

6. The fuse unit as set forth in claim 1, wherein when the first fuse device and the second fuse device are attached to the battery terminal of the battery, the first housing is superposed to the second housing with an offset.

7. The fuse unit as set forth in claim 1, wherein a shape of the first cavity is different from that of the second cavity.

8. The fuse unit as set forth in claim 7, wherein the second housing is further away from the battery than the first housing; and wherein a width of an inner face of the second housing defining the second cavity is greater than that of an inner face of the first housing defining the first cavity.

9. The fuse unit as set forth in claim 8, wherein the inner face of the second housing is widened toward a direction toward the second housing from the first housing.

10. The fuse unit as set forth in claim 7, wherein when the first housing and the second housing are superposed in the direction away from the battery in a state that the second housing further is away from the battery than the first housing, a gap exists between the first housing and the second housing so as to expose the second fusible portion to outside.

* * * * *